United States Patent [19]

Grabenkort

[11] Patent Number: 4,948,000

[45] Date of Patent: Aug. 14, 1990

[54] CONTAINER SHROUDS

[76] Inventor: Richard W. Grabenkort, 102 Carriage Rd., Barrington, Ill. 60010

[21] Appl. No.: 123,387

[22] Filed: Nov. 20, 1987

[51] Int. Cl.[5] ..... B65D 23/08; B65D 81/62

[52] U.S. Cl. ..... 215/12.2; 215/100 A; 215/249; 215/250; 206/438

[58] Field of Search ..... 215/12.1, 249, 100.5, 215/100 R, 100 A, 250; 604/403, 416; 206/438

[56] References Cited

U.S. PATENT DOCUMENTS

| | | | |
|---|---|---|---|
| 1,890,323 | 12/1932 | Glaeser | 215/12.1 |
| 2,741,386 | 4/1956 | Williams | 215/12.1 |
| 2,921,706 | 1/1960 | Johnson | 215/12.1 |
| 3,918,920 | 11/1975 | Barber | 215/12.1 X |
| 4,614,267 | 9/1986 | Larkin | 206/221 |
| 4,614,515 | 9/1986 | Tripp et al. | 604/403 |
| 4,703,864 | 11/1987 | Larkin et al. | 215/256 |
| 4,746,017 | 5/1988 | Howard et al. | 215/249 X |

FOREIGN PATENT DOCUMENTS

| | | | |
|---|---|---|---|
| 2130956 | 12/1971 | Fed. Rep. of Germany | 215/12.1 |

*Primary Examiner*—Sue A. Weaver

*Attorney, Agent, or Firm*—Neuman, Williams, Anderson & Olson

[57] ABSTRACT

A container shroud which is a unitary, molded plastic article is comprised of a substantially cylindrical portion for engaging the body of a vial as well as helical rings or ribs located on the interior wall of the cylindrical portion which serve to grip the periphery of the vial. Additionally, stretch joints formed in the shroud cylindrical wall portion permit circumferential stretch so as to accommodate vials of varying sizes. The shroud has an integral swing up hanger which may be utilized to hang the system with which associated. The shroud provides ease of assembly with good retentive engagement of the vial within a significant range of vial size tolerances, as well as a smooth, uniform, cylindrical, external surface for labelling.

15 Claims, 2 Drawing Sheets

CONTAINER SHROUDS

This invention relates to container shrouds, and more particularly pertains to container shrouds applied over the bodies of containers such as medicament vials. The provided shrouds in conjunction with other cover elements protect a vial and surrounding structure while accommodating a wide variety of vial sizes as well as providing a smooth, uniform, outer surface which facilitates label application.

This invention is useful in systems for delivering pharmaceuticals and other products under sterile conditions, for example as disclosed in U.S. Pat. Nos. 4,614,267 to Larkin and 4,614,515 to Tripp and Larkin, (the disclosures of which are incorporated herein by reference). Such delivery systems include that practiced under the trademark ADD-VANTAGE of Abbott Laboratories of North Chicago, Ill., the assignee of the subject invention. Such systems include a flexible container of diluent adapted to engage a vial or similar medicament container. The resulting connected dual-compartmented container has the contents thereof intermixed from the exterior of such container. The joining of the containers and resulting intermixture of the container contents is done in such manner as to assure sterility.

The vial assembly in the aforementioned ADDVANTAGE system typically includes a molded plastic cover as described in the copending application of Larkin and Tripp, Ser. No. 858385, filed May 1, 1986, now U.S. Pat. No. 4,703,864 latter application is also assigned to the assignee of this invention, and the disclosure of such application is also incorporated herein by this reference.

In the ADD-VANTAGE system the vial covering is comprised of an upper cap portion for covering a stoppered end of such container from which medicament is dispensed. A lower cap portion comprises a skirt which overlaps an adjacent underlying shroud member. The shroud engages the body of the vial and comprises a sleeve snugly surrounding the drug-containing vial. A tear ring may join the upper and lower skirt portions of the cover cap, and when manually removed quickly detaches the cap portion of the cover for quick access to the stoppered end of the vial. The medicament-containing vial is thus encased in a multi-part plastic covering which protects the vial contents during storage and prior to use.

The shroud member which forms the portion of the cover which engages the body of the container or vial must provide a snug fit with the vial while providing for ease of initial cover-vial assembly. Additionally, the design of the shroud should be such that it can provide such a snug fit over a wide variety of vial sizes occasioned by manufacturing tolerances and also provide a smooth outer surface to facilitate labelling. It has been found, for example, that cylindrical medicament-containing vials of one-inch size range employed in the ADD-VANTAGE system have outer diameter variances in the range of $\pm 0.01$ inch. It has also been found that unless the vial shroud provides a smooth outer surface following interfitting with the vial outer periphery, undesired wrinkling of a subsequently applied label results.

It is thus necessary that the shroud portion engaging the body of the container be such as to permit circumferential stretch so as to accommodate vials of varying sizes and provide a taut outer periphery which facilitates and assures desired label application. To this end, a container covering comprising a shroud member with helical rings and stretch joints is provided. It is also highly desirable that the shroud provide a hanger loop or equivalent means from which the system may be conveniently hung when the vial is connected to a fluid source and the resulting solution administered to a patient.

It is thus an object of this invention to provide improved container-cover assemblies, and particularly to provide containers covered by and in combination with such covers which meet the above noted requirements and have the desired characteristics.

SUMMARY OF THE INVENTION

In accordance with this invention there is provided a container-covering assembly which incorporates therein a shroud of novel design. The provided shroud design enhances the manner in which the provided shrouds engage the bodies of cylindrical containers such as vials so as to accommodate vials of varying diametric sizes occasioned by manufacturing tolerances.

The improved container-covering assembly comprises a molded plastic article and includes a shroud member with a substantially cylindrical portion for engaging the body of the vial or container. The shroud portion has formed on the inner surface thereof helical rings or ribs for gripping the outer periphery of the vial. Additionally, longitudinal stretch joints interrupt the rings or ribs and permit circumferential stretch so as to accommodate vials of varying diameters. The shroud has an integral swing-up hanger which may be utilized to hang the final container cover system. This shroud with helical rings or ribs and stretch joints provides a smooth outer surface free of wrinkles for easy labelling.

DESCRIPTION OF THE DRAWINGS

For a more complete understanding of the invention, reference will now be made to the accompanying drawings wherein.

DESCRIPTION OF THE PREFERRED EMBODIMENT

Figure 1:
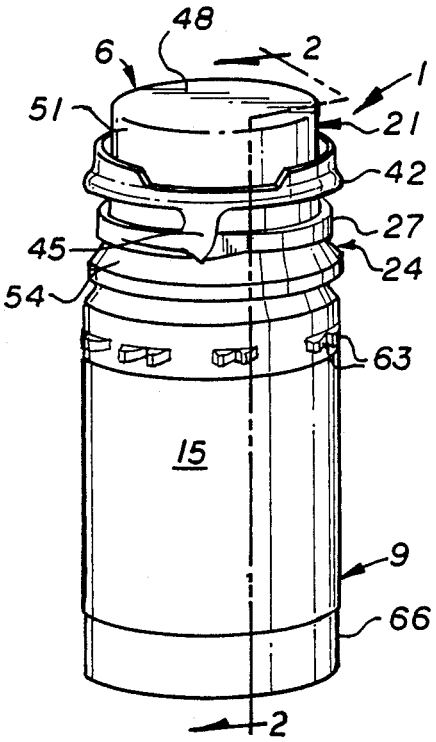
FIG. 1 is a perspective view of a covering and vial assembly made in accordance with the teachings of this invention.

Proceeding with a detailed description of the illustrated embodiment of the invention, FIG. 1 is a perspective view of an outer covering and vial assembly 1. The assembly typically is supplied with a molded plastic cap for application over the access or "finish" end of the container such as a medicament vial as described in the aforementioned copending application of Larkin and Tripp, Ser. No. 858385, filed May 1, 1986, now U.S. Pat. No. 4,703,864.

Figure 2:
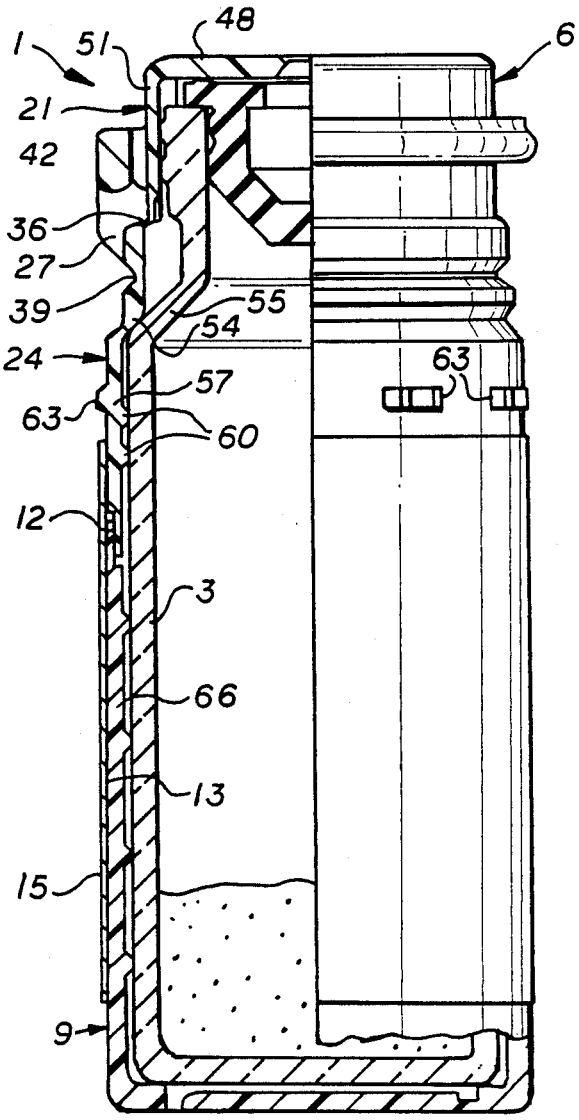
FIG. 2 is a sectional view of one half of the vial and covering of FIG. 1, as taken along a radius, with the other half in elevation (generally along lines 2—2 of FIG. 1)

Referring particularly to FIGS. 1—2 of the drawings, it will be noted that the assembly 1 includes a vial 3 which is enclosed by an upper cover 6 as well as a lower shroud 9 which join one another at an overlap joint 12 at which the upper end of the shroud 9 overlaps the lower end of cover 6. The cover and shroud are further secured together by an adhesive-backed label 15 which encompasses the joint 12 and portions of the cover and shroud extending therefrom.

As previously described in the copending application of Larkin and Tripp, Ser. No. 858385, now U.S. Pat. No. 4,703,864 cover 6 includes a first cap portion 21 and a second, lower, body-engaging cap portion 24. The latter cap portions are joined by a tear strip 27 located intermediate the portions 21 and 24, and joined to portions 21 and 24 by tear joints 36 and 39 respectively. Pull ring 42 is integrally formed with tear strip 27. A section of the pull ring at one side is joined to the tear strip through a force transfer element 45 which assures ready rupture of the tear ring. The cap portion 21 includes an end wall 48 and an annular skirt section 51 which surrounds and extends slightly below the threaded neck of the vial as seen in FIG. 2.

The cover body-engaging portion 24 is formed with an inner sloping shoulder 54 which may serve as a stop seat for a mating outer sloping shoulder 55 of the vial 3. Cover cylindrical portion 57 depending from shoulder 54 fits snugly about the cylindrical main body of the vial 3 as illustrated in FIG. 2 and includes a pair of inwardly projecting annular sealing ridges 60 for tight sliding contact with the vial outer periphery. Ridges 60 provide effective barriers to entry of bacteria or other organisms between the cover inner periphery and vial outer periphery. An annular array of ratchet teeth 63 more clearly seen in FIG. 1 is provided on the outer surface of cover portion 57 for counter-clockwise stop engagement with complementary teeth of an inlet port on a diluent bag or other dispensing container in one mode of use of the covered vial, as further described in the aforementioned U.S. Pat. No. 4,614,515. The ratchet teeth engagement prevents vial disengagement from a diluent bag or the like after threaded engagement is made therewith, thereby assuring a sterile environment which could be destroyed by vial detachment followed by reattachment.

The shroud 9 as seen in FIG. 2 includes a cylindrical body portion 66 which is complementary with the cover 6 for enclosing the lower portion of the vial 3. The shroud 9 is constructed so as to engage and interfit with lower cap portion 24. While the overlap joint 12 is shown in the preferred illustrated embodiment of vial assembly 1, any suitable method of fitting cap portion 24 and shroud 9 together, such as a tongue and groove connection or a butt joint may be used. Additionally, label 15 may be utilized to maintain shroud 9 in mechanical engagement with cap portion 24 by placing side 13 of the label 15 having adhesive thereon in contact with cap portion 24 and shroud 9.

Figure 3:
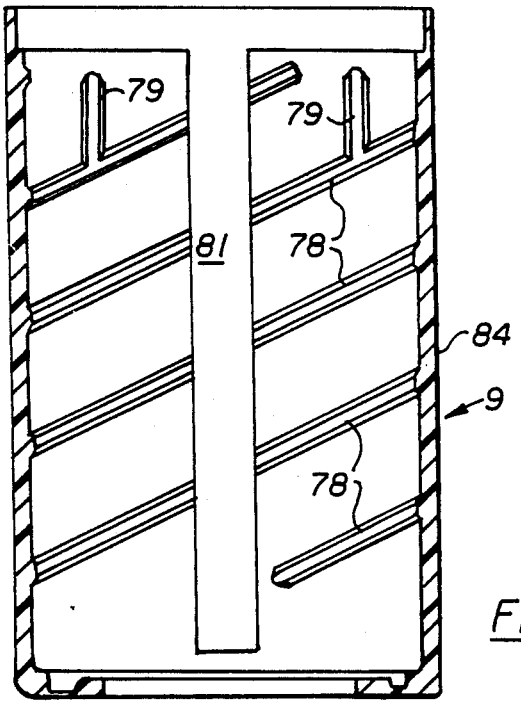
FIG. 3 is a diametric sectional view of the shroud of FIGS. 1 and 2 taken along lines 3—3 of FIG. 4; and illustrating stretch joints therein.

FIG. 3 depicts a sectional view of the shroud 9 made pursuant to this invention. Inwardly projecting helical rings 78 molded on the inner periphery of the shroud 9 provide for easy assembly of the shroud over the outer periphery of glass medicament vial 3 by means of a tight, sliding contact with the vial.

In one illustrative embodiment of a shroud made in accordance with this invention, the helical threads 78 are left hand (reverse) triple lead having a lead of 1.000" and a pitch of 0.333". The presence of the left hand thread has been found to enhance the engagement between the shroud and the vial periphery, in the normal course of threading the vial assembly in place with a normal clockwise rotation as disclosed hereinafter. The height of each helical thread is about 0.020" and the lead angle is 30 degrees. The thread minor diameter or interval between opposed crest portions should preferably be approximately 0.005 inch less than the smallest-diameter vial to be encountered and be able to accommodate diameters 0.020" greater than such minimum. Three stretch joints 81 (FIG. 3) are arranged 120 degrees apart on the shread inner and redice frictional forces and also facilitate assembly of the plastic shroud 9 over the glass vial 3. Each stretch joint forms a portion of wall 84 of the shroud 9, and is a zone of shroud reduced thickness so as to assure that stretching occurs readily in a localized, predetermined area of the shroud or hanger periphery. The width of each stretch joint is calculated such that it is wide enough that the yield point of the material of formation is never reached and thus elastic gripping of the vial is maintained and permanent distortion is minimized. Vertical rib portions 79 of shroud 9 further assist slidable movement of the shroud open end over the periphery of an engaged vial. Rib portions 79 preferably project the same distance from the shroud peripheral wall surface as do the threads 78.

In one embodiment provided by way of example only, the width of the individual stretch joints is 0.167", with the thickness of the shroud wall being reduced to 0.025" at such joints from a thickness of approximately 0.08".

The helical rings or thread portions 78 engage the outer peripheries of engaged vials at the thread crests. The total area of the thread crests which engages the vial periphery is desirably a small percentage of the total area of the shroud inner periphery. As a result, a minimum of frictional resistance is generated by the thread crests while moving over the vial periphery. Such a rest area may be approximately 2% of the total area of the inner periphery of the shroud 9.

The projections 78 and 79 are formed integrally with the inner peripheral surface of the shroud 9. They comprise spacers which space the outer periphery of the shroud from the outer periphery of the vial 3 disposed therein. The small area of contact effected between he engaging surface portions of the threads or ribs such as 78 and 79 assures a minimum of frictional engagement in the course of telescoping the shroud over the vial. If the threads are molded of a sufficiently hard plastic with sharp crests, contacts approaching line contacts may be effected between the threads and vial, further minimizing friction. Increase of hardness, however, reduces the ability of the plastic to stretch at the stretch joints. The minimal shroud-vial contact also prevents many if not most surface imperfections on the encompassed vial from being transmitted to the shroud outer surface.

The thread interval or pitch should be such as to assure a taut, smooth, outer shroud surface for desired label application without the covering sagging between the thread crests.

Figure 4:
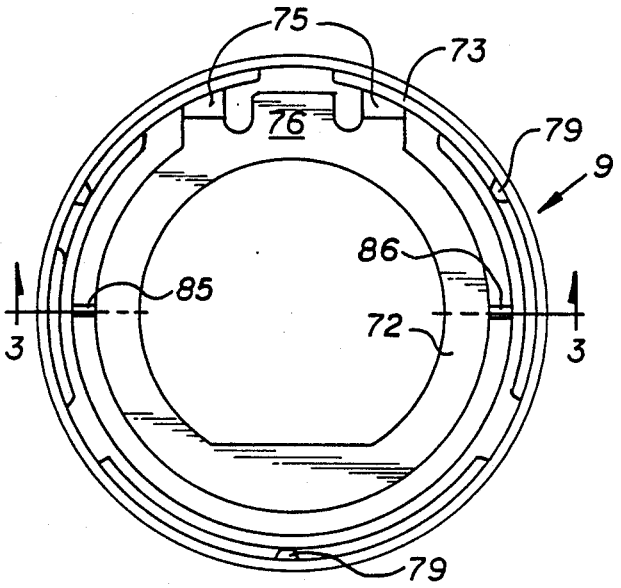
FIG. 4 is a top view of the shroud employed in the assembly of FIGS. 1 and 2.

FIG. 4 is a bottom view of the shroud 9. A means of hanging the shroud (and vial assembly) is provided by including a bottom hanger loop or ring 72 attached to bottom rim 73 of shroud 9. The bottom hanger ring 72 is connected by spaced living hinge connections 75 to the bottom rim 73. Thin, readily frangible attachments 85 and 86 secure the hanger ring 72 by mechanical engagement to the bottom rim 73. When the hanger ring 72 is ready to be utilized, attachments 85 and 86 are easily broken and the hanger ring 72 is moved to an upright position at substantially right angles to the hanger rim 73. Flexible, extension finger 76 is provided adjacent the living hinges 75, and is of a length for abutment with the base of vial 3 when moved into the upright position, but sufficiently flexible to be forcibly moved over center from the position of FIG. 4 to a bracing, vial-engaging position to retain the hanger upright.

Figure 5:
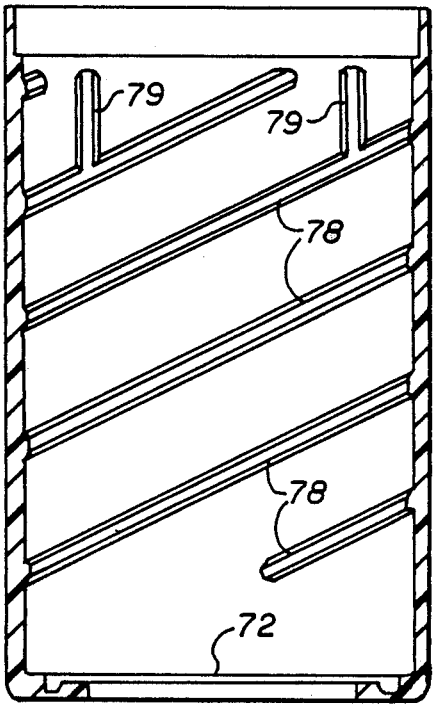
FIG. 5 is a view similar to FIG. 3 of a modified shroud without stretch joints.
Figure 6:
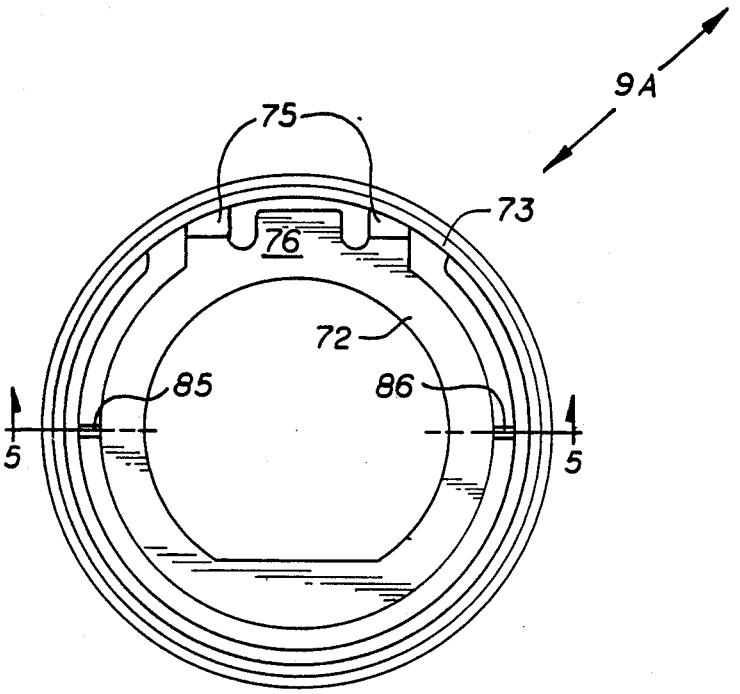
FIG. 6 is a view similar to FIG. 4 of the modified shroud or hanger cap of FIG. 5.

FIGS. 5 and 6 comprise views similar to FIGS. 3 and 4 respectively of a shroud without the stretch joints 81 of the latter figures. These views illustrate a modification 9A of the shroud 9. The shroud embodiment 9A of FIGS. 5 and 6 containing no stretch joints is primarily intended for use with medicament containers or vials of shorter length. It is apparent that with vials of short length less force need be applied for purpose of telescoping the shroud over the bottom of the vial end until it effects the overlap joint 12 with a vial cover cap portion.

However, with vials of greater length (greater than one inch) such as those having a volume of 24 ml. or greater, it is apparent that upon encountering a glass vial having a diameter larger than the average, difficulty will be experienced in the course of forcing the open, receiving end of the shroud over the bottom of the vial. To further assist with the telescoping of the shroud 9 made in accordance with this invention over a vial, the shrouds are provided with stretch joints 81. As a result, when the open receiving end of the shroud 9 is applied over the bottom end of the vial 3 by means of an axial pushing force, the receiving end of the shroud 9 will first move over the bottom end of the vial. The raised ribs 78 and 79 will provide the desired minimum areas of contact between the shroud and the outer periphery of the vial, allowing a desired telescoping action to take place and if necessary stretching to take place at the stretch joints 81. The pitch of the helical threads is such that the outer shroud surface portions disposed therebetween are never allowed to flex inwardly, indent or "cave in" enough to cause label wrinkling. Such caving action is detrimental to the appearance of a label when affixed thereover, and may even have a tendency to disengage the label from the shroud portion of the assembly.

The normal engagement of the shroud over the vial comprises a well-known "Chinese hand-cuffs" effect wherein the receiving shroud end first passes over the vial, and the axial pushing of the shroud tends to urge such receiving end into a maximum-diameter mode as it moves along the length of the vial to be enveloped. Any attempted axial withdrawal of the shroud from the engaged vial would have a tendency to collapse the shroud along the length thereof so as to assure and enhance a desired snug engagement between the vial and shroud at all times.

It is thus seen that the provided shroud of this invention solves two problems which had previously existed in the formation of assemblies of the type above-described. The provided rib arrangement comprises a shroud construction which is able to be readily commercially molded and able to snugly engage the peripheries of vials manufactured in accordance with normal tolerances, with practical ease of axial sliding assembly of the shrouds onto the vials. Although the stretch joints are not needed for relatively short vial constructions, one inch or shorter, they do comprise a feature of this invention. They maintain snug engagement of the shrouds on vials of greater length and enable the practice of practical axial sliding assembly techniques. As above noted, the pitch of the helical spirals or threads molded integrally on the inner periphery of the shroud should be such as to insure a firm uniform cylindrical outer shroud surface for desired label application without any "caving" between the underlying ribs or helices. The provided helices in addition to assuring the rigidity of the shroud are surfaces providing a minimum of frictional contact between the shroud and the vial. The helices thus minimize frictional resistance in the course of effecting a desired telescopic engagement such as that illustrated in FIG. 2 wherein the upper portion of the shroud effects an overlap seal 12 with the bottom periphery of the upper cover 6, and the bottom of the shroud is substantially in engagement with the vial bottom.

It is believed apparent that in accordance with the plastics used, the area of contact between the ribs and the vial may be increased or decreased depending on the lubricity inherent in the plastic. In addition, depending upon the rigidity of the plastic, the pitch of the helical threads may vary so as to assure a desired outer cylindrical surface without any attendant buckling or "cave in".

The provided shroud of this invention is a unitary plastic molding of a suitable plastic such as a polypropylene copolymer which is accurately moldable to close tolerances, and is dimensionally stable, flexible and resilient. It will be noted that the shrouds 9 and 9A may be molded within substantially precise dimensional tolerances so as to desirably engage the peripheries of the glass vials 3 having variances in diameter.

It will be appreciated by those skilled in the art that the number of stretch joints present in a shroud is not limited to that in the illustrated embodiment. Also, the dimensions of the ribs or threads may depart from the above-discussed illustrative embodiments as may other characteristics of the formed threads if the desired shroud surface configuration is obtained. In longer vials in excess of one inch, circular ribs are to be avoided because of the difficulty in stretching when engaging vials of greater diameter. Such difficulty results in the consequent inability to properly telescope the shroud over the vial body.

The foregoing invention can now be practiced by those skilled in the art. Such skilled persons will know that the invention is not necessarily restricted to the particular embodiments presented herein. The scope of the invention is to be defined by the terms of the following claims.

What is claimed is:

1. A shroud for snugly engaging the outer periphery of a vial or the like comprising a body portion formed of a resilient material and having an open receiving end for receiving the outer periphery of a vial or the like therethrough; raised ribs formed on the inner periphery of said body portion for substantially uniformly spacing the outer periphery of said shroud from the outer periphery of a vial or the like when snugly engaged therewith, and at least one longitudinal strength joint comprising an area of said shroud of reduced thickness which enables said shroud to resiliently enlarge circumferentially.

2. In a shroud for a vial having an outer peripheral surface of substantially cylindrical configuration, the combination comprising a shroud body formed of a resilient material and having an inner peripheral surface of substantially cylindrical configuration with raised spacer means formed on the inner peripheral surface of said shroud body in the form of a helical rib; the crest portions of said rib defining a support surface area having the same central longitudinal axis of formation as said shroud inner peripheral surface; at least one longitudinal wall portion of said shroud body being reduced in thickness whereby a shroud zone is provided enabling said shroud body to be resiliently enlarged circumferentially.

3. The shroud of claim 2 in which said helical rib is interrupted by said at least one longitudinal wall portion of reduced thickness.

4. The shroud of claim 2 in which said distal crest portions of said rib comprise approximately 2% of the surface area of said shroud inner periphery.

5. In a shroud for providing an outer protective covering for a vial or the like, and having a cylindrical body formed of resilient material and adapted to snugly engage the outer periphery of a vial or the like, the improvement comprising means allowing the shroud to resiliently expand circumferentially formed with said cylindrical body substantially parallel to the longitudinal axis thereof; said means comprising a longitudinal wall portion of reduced thickness.

6. A shroud for snugly engaging the outer periphery of a vial or the like, comprising a body portion formed of a resilient material and having an open, receiving end for receiving the outer periphery of a vial or the like therethrough, raised, non-circular ribs formed on the inner periphery of the shroud body portion for substantially uniformly spacing the outer periphery of said shroud from the outer periphery of a vial or the like when snugly engaged therewith, and means for hanging said shroud from a support; said means being integrally formed with a portion of said shroud body spaced from said receiving end; said shroud having at least one longitudinal stretch joint which traverses and interrupts portions of said ribs, said stretch joint comprising an area of such shroud of reduced thickness which enables said shroud to resiliently enlarge circumferentially.

7. A shroud for snugly engaging the outer periphery of a vial or the like, comprising a body portion having an open, receiving end for receiving the outer periphery of a vial or the like therethrough; raised non-circular ribs circumferentially formed about the inner periphery of the shroud body portion for substantially uniformly spacing the outer periphery of said shroud from the outer periphery of a vial or the like when snugly engaged therewith, some of said ribs being of helical configuration.

8. The shroud of claim 7 in combination with means for having said shroud from a support; said means being integrally formed with the portion of said shroud body spaced from said receiving end.

9. The shroud of claim 1 or 6 in which some of said ribs formed in said shroud are of helical configuration.

10. The shroud of claim 1 or 6 in which the terminus of said shroud receiving end has an annular end portion of reduced thickness extending therefrom; said annular end portion being free of said ribs.

11. The shroud of claim 10 in which spaced, straight, longitudinally extending rib portions extend along said shroud inner periphery from the inner end of said annular end portion of reduced thickness.

12. In combination, a cylindrical vial having a substantially uniform cylindrical surface portion; a generally cylindrical shroud formed of resilient material and snugly engaging said vial cylindrical surface portion; spacer means comprising at least one helical rib integrally molded on the inner periphery of said shroud and having inner distal portions engaging the vial cylindrical surface portion; said inner distal portions defining an area approximately 2% of the area of said shroud inner periphery from which said spacer means project; said spacer means being of such size and arrangement between the vial outer periphery and the shroud inner periphery that the outer shroud periphery is cylindrical and taut, free of depressions.

13. The combination of claim 12 in which said vial cylindrical surface portion has a diameter at least 0.005" larger than the diameter of the cylindrical surface defined in part by the inner distal portions of said spacer means prior to engagement with said vial.

14. The combination of claim 12 in which said helical rib is in the form of multiple helices.

15. The combination of claim 12 in which stretch joints spaced 120 degrees apart extend longitudinally in said shroud; said stretch joints comprising areas of reduced thickness in said shroud which enable said shroud to resiliently enlarge upon engaging a vial of larger diameter.

* * * * *